United States Patent [19]

Westplate

[11] Patent Number: 4,562,672

[45] Date of Patent: Jan. 7, 1986

[54] STAKE FOR CONCRETE SMOOTHING OPERATION

[76] Inventor: Adrian Westplate, 7612 33rd Ave., Kenosha, Wis. 53142

[21] Appl. No.: 511,875

[22] Filed: Jul. 8, 1983

[51] Int. Cl.[4] ..... E04F 21/06

[52] U.S. Cl. ..... 52/105; 52/365; 52/687

[58] Field of Search ..... 33/290, 293; 52/155, 52/165, 361, 365, 370, 687, 689, 105; 256/1, 11

[56] References Cited

U.S. PATENT DOCUMENTS

| | | | |
|---|---|---|---|
| 184,635 | 11/1876 | Lennon | 256/58 |
| 223,093 | 12/1879 | Barnhill et al. | 256/11 |
| 1,212,843 | 1/1917 | Struchen | 52/370 |
| 1,263,132 | 4/1918 | Sharpe | 52/155 |
| 1,788,481 | 1/1931 | Brostrom | 52/365 |
| 2,592,626 | 4/1952 | Wanless | 405/218 |
| 2,835,017 | 5/1958 | Hoerr | 256/1 |
| 3,255,565 | 1/1966 | Menzel | 52/687 |

FOREIGN PATENT DOCUMENTS

| | | | |
|---|---|---|---|
| 431000 | 8/1967 | Switzerland | 52/687 |
| 526247 | of 1940 | United Kingdom | 52/687 |

*Primary Examiner*—James L. Ridgill, Jr.
*Attorney, Agent, or Firm*—Peter N. Jansson

[57] ABSTRACT

An improved stake for supporting guides for screed members used in concrete smoothing. The stake is a hollow, open-ended tube having a wall of substantially uniform cross-section along at least most of its length, and having an upper edge adapted to support a guide rod or bar and a lower edge adapted for ground cutting. Certain embodiments include pairs of slots for receiving inserts which assist in determining the proper depth to which the stake should be driven.

13 Claims, 4 Drawing Figures

STAKE FOR CONCRETE SMOOTHING OPERATION

FIELD OF THE INVENTION

This invention is related generally to devices and methods for screeding concrete, and more specifically to stakes used to support guides for screed members in screeding large concrete slabs.

BACKGROUND OF THE INVENTION

Smoothing and finishing a newly poured concrete surface has customarily involved a time-consuming and difficult process requiring considerable skill. The job is particularly difficult when the concrete surface is wide, as it often is for driveways and other surfaces. However, correct smoothing and finishing is important for a number of reasons, such as the need to achieve a high quality appearance for the surface, to avoid cracking, to obtain proper drainage, and for other obvious reasons. Thus, a thorough and accurate screeding operation is of utmost importance.

To guide elongated screed members, it has been the common practice to drive rows of wooden stakes (into the ground over which the concrete is to be poured) for the purpose of supporting guide rods or bars, such as pipes. The stakes are typically made of framing lumber having a slant-cut or double slant-cut point to aid in driving. The stakes are measured and leveled as well as possible so that their tops lie a fixed distance below the intended surface level of the concrete being poured. Rods or bars are then secured on top of the stakes to serve as guides for the screed members, which extend transversly thereacross during leveling.

This process is often made particularly time-consuming and difficult by problems encountered with the stakes. Often the stakes cannot be driven easily into the ground. Sometimes particular difficulty is experienced in securing all stakes at the right depth with sufficient sturdiness to adequately be kept in place. Frequently, after being placed into the ground, the stakes or some of them wiggle out of place during the screeding operation.

Expensive devices have been developed to facilitate the concrete screeding process. See, for example, the devices dislosed in U.S. Pat. Nos. 4,229,118, 4,105,355, 4,321,024, and 4,115,976. There has been a long-felt need for a simple, inexpensive stake to facilitate the screeding process.

BRIEF SUMMARY OF THE INVENTION

This invention is an improved stake which greatly facilitates the concrete screeding process, and overcomes the aforementioned problems of the prior art.

The stake of this invention is a hollow, open-ended, preferably thin-walled tube of generally constant cross-section along its length, and having an upper edge adapted to support, typically with another similar stake, a screed guide rod or bar and having a lower edge adapted for ground cutting to aid in driving the stake. The lower edge of the stake is substantially coincident with the wall which forms the stake, rather than extending radially inward.

In preferred embodiments of this invention, the lower edge of the stake has points to facilitate driving into the ground, preferably two points on opposing portions of the stake wall. Likewise, the upper edge of the stake, which preferably is coincident with the stake wall, preferably has two cradle portions on opposing portions of the wall to receive and hold the screed guide rod or bar.

Along the mid-length of the stake of this invention, there is preferably at least one pair of facing slots in opposing portions of the stake wall for the purpose of receiving a depth-defining insert which will then extend across the hollow interior of the stake. Such insert will limit the extent to which the stake is driven into the ground and thus serve as a gauge to help achieve a level surface without great difficulty.

In certain highly preferred embodiments of this invention, the stake is made of sheet metal. A good example of the type of material which is preferred for the stakes of this invention is the steel tube material widely used for downspouts on houses. Sheet steel tubing having a material thickness of about 0.020–0.040 inch is preferred. It is also preferred that such tubing be of a generally round cross-section, to provide strong points.

It has been found that the stakes of this invention substantially facilitate and shorten the concrete screeding process. While not wanting to be bound by any theoretical considerations, it is believed that the inventive stakes are more easily driven because a great deal of ground does not have to be moved during driving. It is also believed that the inventive stakes remain more securely in place because the ground within the stakes serves to hold the stakes rigid even against the lateral pressure of the screeding motion.

It is noteworthy that when the guide bars or rods are removed from their cradled positions across the stakes of this invention, concrete may be poured into the hollow, open-ended stakes prior to final smoothing of the concrete. Since the stakes, which are then permanently embedded beneath the finished concrete surface, are filled with concrete, there is no possibility of stake deterioration which could cause weakness in the concrete at a later date.

The stakes of this invention may be used much more easily than stakes of the prior art. The stakes of this invention provide substantial advantage to both the concrete craftsman and the inexperienced worker alike. The inventive stakes are very inexpensive to manufacture, and provide substantial savings in time and improvements in the quality of the concrete surfaces formed.

OBJECTS OF THE INVENTION

It is an object of this invention to provide simple, improved apparatus for the concrete screeding process which overcomes problems of the prior art.

Another object of this invention is to provide an improved stake for use in the concrete screeding process.

Another object of this invention is to provide an improved stake for the concrete screeding process which will be easily driven and not easily dislodged.

Yet another object of this invention is to provide a stake for the concrete screeding process which may easily be inserted to the correct depth for a level surface.

These and other objects will be apparent from the following additional description including the drawings, wherein:

DETAILED DESCRIPTION OF PREFERRED EMBODIMENTS

Figure 1:
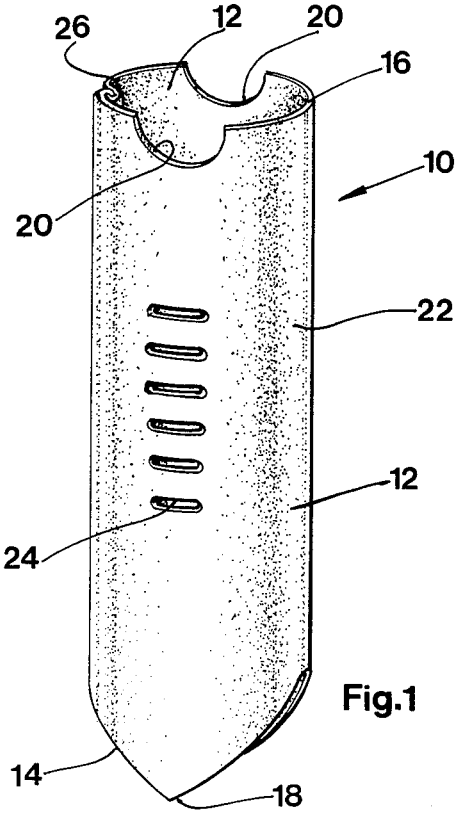
FIG. 1 is a perspective view of a preferred stake in accordance with this invention.

The figures illustrate a preferred stake 10 of this invention. Stake 10 has a wall 12 formed of thin steel. Wall 12 has a substantially uniform cross-section along its entire length; that is, its cross-sections are substantially coincident along its entire length. Stake 10 is a hollow and open-ended tube which is substantially rigid such that it can be driven into the ground without significantly deforming.

Stake 10 has a lower edge 14 and an upper edge 16. Both of these edges are substantially coincident with wall 12. Lower edge 14 is adapted for ground cutting by having two points 18 on opposing portions of wall 12. Instead of having two points, lower edge could have one or three points, or be otherwise adapted for ground cutting. Upper edge 16 has U-shaped cradle portions 20 on opposing portions of wall 12. Cradle portions 20 serve to support guide rods or bars across which the screeding member extends during the concrete leveling operation. Upper edge 16 could have other means to support the guide members, but cradle portions 20 are highly preferred.

Stake 10 also has a mid-length portion 22 in which there are several pairs of facing slots 24 in opposing portions of wall 12. (One slot of each pair is shown.) Each pair of facing slots 24 is spaced a different distance from upper edge 16 of stake 10. When a flat insert piece (not shown) is supported between one pair of slots 24, it extends across the hollow tube and serves as a guide for the amount of insertion into the ground for the stake. Thus, such an insert may be referred to as a depth-defining insert. It facilitates the process of achieving a level concrete surface.

Figure 4:
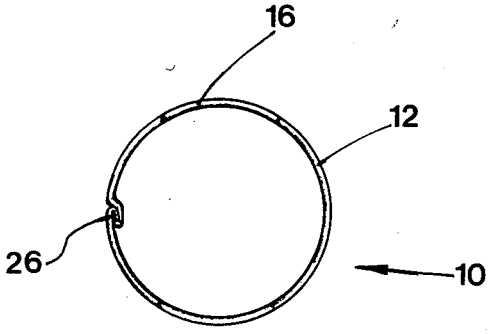
FIG. 4 is a top plan view.
Figure 2:
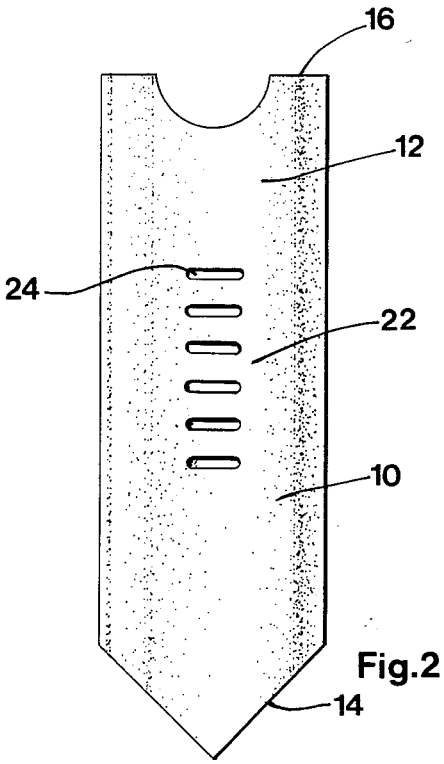
FIG. 2 is a front elevation of the device of FIG. 1.
Figure 3:
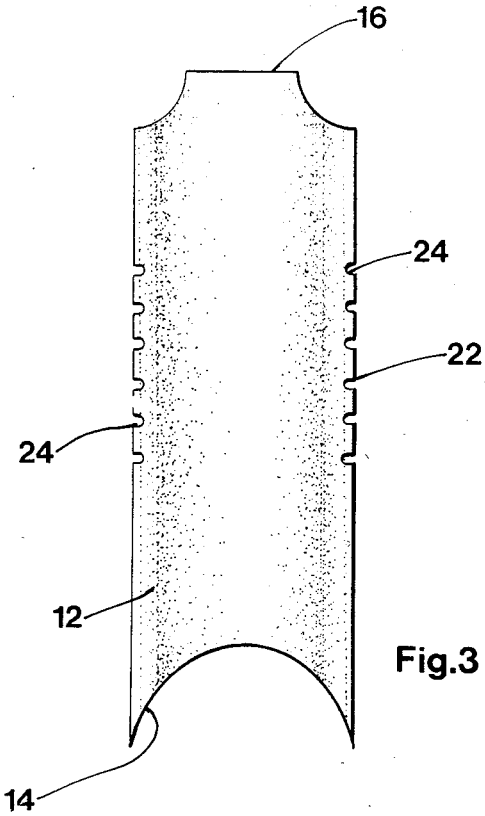
FIG. 3 is a right side elevation.

Stake 10 has a substantially round cross-section along its entire length. Stake 10 is formed of sheet steel having a thickness of 0.030 inch, which is seamed together at seam 26 as shown in FIG. 4. Somewhat thicker or thinner rigid material can be used, depending upon the hardness of the ground into which the stake will be driven. Stakes in accordance with this invention can be made in a variety of ways not specifically described here.

Upper edge 16 could bend during stake driving, particularly if it is hit carelessly with a sharp hammer end. The driving of stake 10 can be facilitated by using a hard, preferably solid metal driving member (not shown) which is designed to be received snugly into the top of stake 10 and engage upper edge 16. Such a driving member presents a surface for hammering which cannot be bent. This sort of driving member allows the use of thinner walled materials than otherwise might be possible.

While sheet steel is a highly preferred material for stake 10, other materials can be used, depending on their strength. In this connection, it should again be emphasized that choice of materials is dependent on many factors, including cost and the nature of the ground into which the stakes will be driven. The length of the stakes is dependent on the hardness of the ground as well. However, a preferred length is about 8–12 inches. Acceptable widths can vary considerably; however, a preferred width is on the order of 2–4 inches.

While the wall of stakes in accordance with this invention are of substantially coincident cross-section substantially along their lengths, minor variations in cross-section are acceptable. Thus, for example, the cross-section might be narrowed near the upper edge to facilitate stake driving. Other minor cross-sectional variations are also acceptable.

The generally round cross-sectional shape of stake 10 is preferred. However, stakes in accordance with this invention could be generally square in cross-section or have a variety of other cross-sectional configurations.

While the principles of this invention have been described in connection with specific apparatus, it should be understood clearly that these descriptions are made only by way of example and not are not intended as limitations in the scope of the invention.

What is claimed is:

1. An improved screed guide supporting stake for use in concrete-smoothing operations, comprising a unitary hollow open-ended ground-receiving tube with a wall of substantially coincident cross-sections substantially along its length, said unitary tube having an upper edge having cradle means to receive one of said screed guides thereacross and a lower edge having point means for ground cutting, said lower edge being substantially coincident with said wall.

2. The stake of claim 1 wherein said upper edge is substantially coincident with said wall and has two cradle portions on opposing portions of said wall.

3. The stake of claim 1 wherein mid-length therealong at least one pair of facing slots are in opposing portions of said wall, said pair of slots adapted to receive a depth-defining insert.

4. The stake of claim 1 wherein the wall has a substantially round cross-section.

5. The stake of claim 1 wherein the wall is made of sheet metal.

6. The stake of claim 5 wherein the sheet metal is steel having a thickness of about 0.020–0.040 inch.

7. The stake of claim 1 wherein said lower edge has a plurality of points.

8. The stake of claim 2 wherein said lower edge has two points on opposing portions of said wall.

9. The stake of claim 3 wherein said upper edge is substantially coincident with said wall and has two cradle portions on opposing portions of said wall.

10. The stake of claim 9 wherein mid-length therealong at least one pair of facing slots are in opposing portions of said wall, said pair of slots adapted to receive a depth-defining insert.

11. The stake of claim 10 wherein the wall is made of sheet metal.

12. The stake of claim 11 wherein the sheet metal is steel having a thickness of about 0.020–0.040 inch.

13. The stake of claim 12 wherein the wall has a substantially round cross-section.

* * * * *